United States Patent [19]

Giguere

[11] Patent Number: 4,945,680

[45] Date of Patent: Aug. 7, 1990

[54] THRESHOLD SYSTEM FOR A DOMESTIC DOOR

[75] Inventor: Jean P. Giguere, St-Apollinaire, Canada

[73] Assignee: Donat Flamand Inc., St-Apollinaire, Canada

[21] Appl. No.: 310,289

[22] Filed: Feb. 14, 1989

[51] Int. Cl.[5] ..... E06B 1/70

[52] U.S. Cl. ..... 49/468; 49/467; 52/209

[58] Field of Search ..... 49/467, 468, 470, 471, 49/476; 52/209

[56] References Cited

U.S. PATENT DOCUMENTS 1,563,409 12/1925 Walker .
2,880,477 4/1959 Kunkel .
3,114,180 12/1963 Riedl .
3,346,994 10/1967 Kesler .
3,967,412 7/1976 Governale .
4,114,319 9/1978 Governale ..... 49/470
4,447,987 5/1984 Lesosky ..... 49/468
4,513,536 4/1985 Giguère .

*Primary Examiner*—Kenneth J. Dorner
*Assistant Examiner*—Gerald Anderson
*Attorney, Agent, or Firm*—Cushman, Darby & Cushman

[57] ABSTRACT

Threshold system for a domestic door of the type comprising a pivotable panel, the threshold system including a stationary sill adn a weather-strip carrier mounted on the lower edge of the pivotable panel. When the pivotable panel is in the closed position, the sill and the weather-strip carrier are generally parallel and slightly spaced from one another along a vertical axis. The space between these elements is closed by two weather-strips mounted to the weather-strip carrier and extending on either side of a water-catch pan formed on the sill element. The water-catch pan collects water droplets passing through the outer weather-strip.

8 Claims, 1 Drawing Sheet

THRESHOLD SYSTEM FOR A DOMESTIC DOOR

FIELD OF THE INVENTION

The present invention relates to the art of insulating domestic doors against air and water infiltration, and more particularly, the invention relates to an improved threshold system provided with a water-catch pan to collect water infiltrating through the threshold system.

BACKGROUND OF THE INVENTION

Threshold systems of conventional construction are often inefficient in preventing air and water from infiltrating toward the interior of a dwelling since, in most of these designs, the sealing effect is obtained by application of a single weather-strip against a mating surface. However, when strong winds prevail, the pressure difference between the exterior and the interior of the dwelling contributes to detach the weather-strip from its mating surface, thus forming a passage allowing water droplets and cold air to penetrate the dwelling. This passage being relatively small, the cold air mass passes with a high velocity, further contributing to entrain water droplets toward the interior of the dwelling.

OBJECT AND STATEMENT OF THE INVENTION

An object of the present invention is an improved threshold system for a domestic door, with good sealing characteristics to reduce the possibility of air and water infiltration.

The threshold system, according to the invention, comprises a sill mounted on a suitable supporting structure, thus being substantially stationary, and a mobile element which extends along the sill when the door panel is in the closed position, the space between the sill and the mobile element being closed by two elongated weather-strips. Between the weather-strips is provided a water-catch pan for catching water droplets which may have passed through the outer weather-strip, thus reducing the possibility of water infiltration through the inner weather-strip.

In a preferred embodiment, the water-catch pan includes drainage openings communicating with the exterior of the dwelling, allowing water collected in the pan to be eliminated.

Preferably, the sill of the threshold system comprises a seat receiving an elongated block on whose upper face is removably mounted a channel forming the water-catch pan. The block is retained in the seat by adjustment screws allowing variations in the vertical position of the block in order to precisely adjust and maintain the parallelism between the sill and the mobile element of the threshold system, thus obtaining a good sealing contact between the weather-strips and the sill.

The invention also extends to a door using this threshold system.

DESCRIPTION OF A PREFERRED EMBODIMENT

Figure 1:
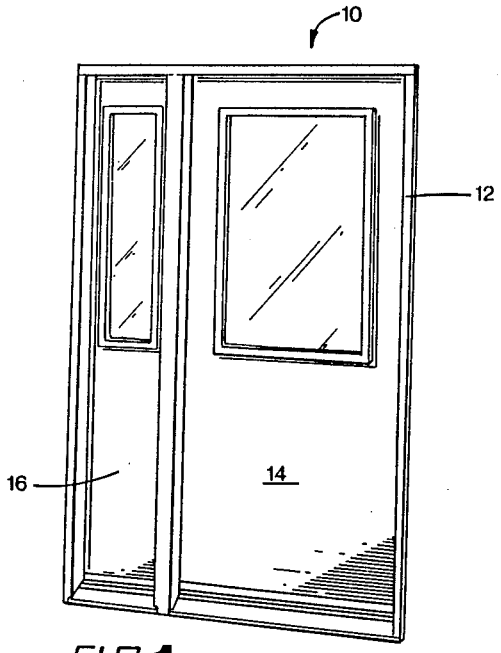
FIG. 1 is a perspective view of a domestic door with a threshold system, in accordance with the invention.

Referring now to the annexed drawings, and more particularly to FIG. 1, the reference numeral 10 designates a domestic door that may be used as an entrance door of a dwelling. The door 10 comprises a frame 12 on which is mounted a mobile panel 14 that can pivot with respect to the frame 12. If desired, a smaller mobile panel 16 may be provided, adjacent the main panel 14, for aeration purposes. This panel 16 may advantageously replace a conventional screen door.

Figure 2:
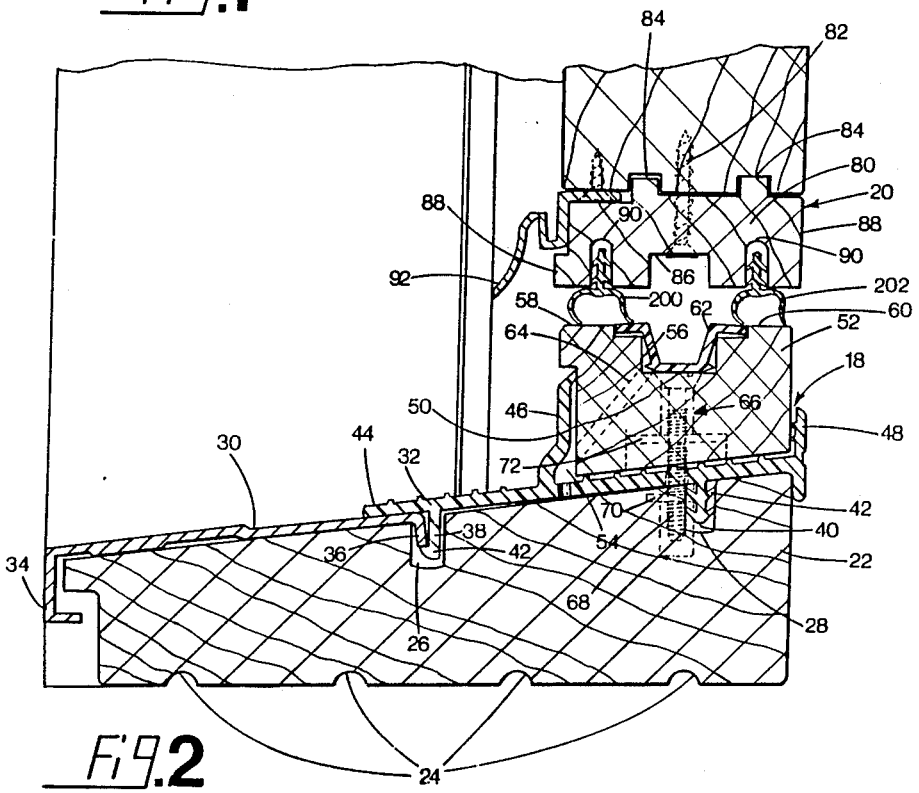
FIG. 2 is an enlarged vertical sectional view of the threshold system, in accordance with the invention.

Referring now to FIG. 2, the threshold system of the door 10, in accordance with the invention, is constituted by two elements, namely a stationary sill 18 and a mobile weather-strip carrier 20 mounted on the lower edge of the door panel 14. The sill 18 comprises a tapered wooden block 22 mounted on a suitable support (not shown) by means of appropriate fasteners. On the lower face of the tapered block 22 are formed a series of longitudinal grooves 24, namely four grooves, in order to form an intermittant contact surface between the tapered block 22 and the sill support. Such an intermittant surface reduces the risks of water infiltration by capillary effect.

On the upper face of the tapered block 22 are provided two longitudinal grooves 26 and 28 receiving the retaining legs of covering plates 30 and 32 overlying the tapered block 22.

More particularly, the covering plate 30 is a vinyl extrusion comprising a top generally flat face having at the front a downwardly extending L-shaped retaining leg 34, and at the rear, a straight retaining leg 36 received in the groove 26. In addition to the retaining legs 34 and 36, screws or nails may be provided to obtain an additional retaining force between the covering plate 30 and the tapered block 22.

The plate 32 is an aluminum extrusion comprising two retaining legs 38 and 40 received in the grooves 26 and 28 respectively, each retaining leg being provided with ribs 42 of conventional construction. At the front, the plate 32 terminates by a tongue 44 extending over the covering plate 30. Two vertical projections 46 and 48 on the plate 32 define therebetween a seat 50 for receiving an elongated wooden block 52 whose structure will be described in detail hereinafter. The vertical projection 46 is substantially longer than the projection 48 and it comprises a bend at the base thereof defining a cavity 54 in the seat 50. Perforations (not illustrated in the drawings) are provided on the vertical projection 46, at the level of the base thereof, to establish a communication between the cavity 54 and the exterior.

The block 52, having a generally constant cross-section throughout the length thereof, comprises on its upper face a deep groove 56 extending along the entire length of the block 52 and being edged by two horizontal surfaces 58 and 60 serving as mating surfaces for weather-strips which will be described hereinafter. In the groove 56 is mounted by press-fit a channel 62 made of plastic material constituting a water-catch pan. In the channel 62 are provided drainage openings (not illustrated) in register with drainage channels 64 provided in the wooden block 52 which lead to the cavity 54.

The block 52 is mounted in the seat 50 by means of adjustment screws 66. This adjusting system is of the type comprising a screw 68 threaded at its extremity and being received in a nut secured in the tapered block 22. Although not illustrated in the drawings, it is plain that an opening is provided on the covering plate 32 through which extends the screw 68.

The block 52 is retained to the screw 68 by means of a special nut 72, of a generally known construction, allowing the free rotation of the screw, however, preventing any displacement of the screw 68 relatively to the nut 72 along the axis of the screw 68.

The number of adjustment screws 68 may vary, however at least two are used, mounted at spaced locations along the longitudinal axis of the block 52, thus allowing to incline the block 52 during adjustment procedures performed to maintain the parallelism between the sill 18 and the weather-strip carrier 20.

The mobile weather-strip carrier 20 comprises a wooden plate 80 mounted to the lower edge of the door panel 14 by screws 82, located at equidistant intervals along the plate 80. To obtain a precise alignment between the panel 14 and the weather-strip carrier 20, a tongue and groove type engagement 84 is provided between the plate 80 and the panel 14. On the lower face of the plate 80 is formed a groove 86 having a generally rectangular cross-section edged by two legs 88 provided with deep and narrow grooves 90 receiving weather-strips 200 and 202, of the same length as the sill 18 and the weather-strip carrier 20. These weather-strips may be of the type described in the applicant's Canadian Pat. No. 1,238,528.

It should be appreciated that the use of a separate wooden plate 80 to be mounted on the door panel 14 is not an essential feature of the invention since it may very well be envisaged to directly mount the weather-strips 200 and 202 on the panel 14, and to form the groove 80 directly on the lower edge of the mobile panel 14.

If desired, a drip-molding 92 to deflect water, may be mounted between the door panel 14 and the plate 80.

When the door panel 14 is in the closed position, any water droplets which may have penetrated between the external weather-strip 200 and the block 52 will, by effect of gravity, flow in the water-catch pan 62 and they will be evacuated to the exterior through the perforations on the channel 56, the drainage channels 64 and the perforations at the base of the vertical projection 46.

If the parallelism between the block 52 and the plate 80 is lost, due to warpage for example, it is possible to correct the situation by adjusting the position of the block 52 in the seat 50. To achieve the adjustment, it is sufficient to remove the channel 56 to expose the heads of the screws 68. By turning one or more of these screws in the appropriate direction, it is possible to position the block 52 as desired in order to obtain a good contact between the weather-strips 200 and 202 and the horizontal surfaces 58 and 60 respectively, when the panel 14 is in the closed position.

Various modifications of the preferred embodiment of the invention described above, may be made without departing from the spirit of the invention. For example, it may be envisaged to use material other than wood for the manufacture of the elements 22, 52 and 80 in order to obtain a better thermal insulation. It is within the present art to select this material in accordance with the specific application.

I claim:

1. A threshold system for a domestic door of the type including a mobile panel, said threshold system comprising:

an elongated sill element mounted to a supporting structure, comprising:

a) a base member mounted to said supporting structure, said base member defining a seat;

b) an elongated member mounted in said seat, said elongated member comprising a longitudinally extending recess;

c) a channel made of plastic material removably mounted in said recess, said channel constituting a water-catch pan;

d) control means for adjusting the position of said elongated member in said seat, said control means being accessible for adjustment upon removal of said channel from said recess, an elongated movable element for mounting to said panel, said movable element overlying said sill element and being generally parallel thereto when said panel is in a closed position, a space being defined between said elements when said panel is in a closed position;

two weather strips mounted to one of said elements for closing said space, said weather strips being generally parallel to said water-catch pane and extending on either side thereof; and drainage means establishing a fluid communication between said water-catch pan and the exterior.

2. A threshold system as defined in claim 1, wherein said control means comprises at least two adjustment screws coupled to said elongated member, the rotation of said screws causing a shift in the vertical position of said elongated member with respect to said seat.

3. A threshold system as defined in claim 1, wherein said elongated member comprises a top face, said water-catch pan being on said top face, said top face further including two generally horizontal surfaces on either side of said water-catch pan.

4. A threshold system as defined in claim 3, wherein said weather strips are mounted to said elongated mobile element, when said pivotable panel is in the closed position each weather strip being in contact with a respective generally horizontal surface of the elongated member.

5. A domestic door comprising:

a frame;

a panel pivotally mounted to said frame, said panel comprising a lower edge;

a sill mounted to a supporting structure, said sill being generally parallel to said lower edge when said panel is in a closed position, a space being defined between said sill and said lower edge when said panel is in a closed position, said sill comprising:

a) a base member mounted to said supporting structure, said base member defining a seat;

b) an elongated member mounted in said seat, said elongated member comprising a longitudinally extending recess;

c) a channel made of plastic material removably mounted in said recess, said channel constituting a water-catch pan;

d) control means for adjusting the position of said elongated member in said seat, said control means being accessible for adjustment upon removal of said channel from said seat;

weather stripping mounted to either one of said sill and panel for closing said space; and drainage means establishing a fluid communication between said water-catch pan and the exterior.

6. A domestic door as defined in claim 5, wherein said weather stripping comprises two generally parallel weather strips.

7. A domestic door, as defined in claim 5, wherein said control means comprises at least two adjustment screws coupled to said elongated member, rotation of said screws allowing to vary the vertical position of said elongated member in said seat.

8. A domestic door, as defined in claim 5, wherein said elongated member comprises a top face, said water-catch pan being on said top face, said top face further comprising two generally horizontal surfaces on either side of said water-catch pan.

* * * * *